US006445352B1

(12) United States Patent
Cohen

(10) Patent No.: US 6,445,352 B1
(45) Date of Patent: Sep. 3, 2002

(54) CYLINDRICAL CONFORMABLE ANTENNA ON A PLANAR SUBSTRATE

(75) Inventor: Nathan Cohen, Belmont, MA (US)

(73) Assignee: Fractal Antenna Systems, Inc., Malden, MA (US)

( * ) Notice: Subject to any disclaimer, the term of this patent is extended or adjusted under 35 U.S.C. 154(b) by 0 days.

(21) Appl. No.: 09/700,005

(22) PCT Filed: Nov. 20, 1998

(86) PCT No.: PCT/US98/24794

§ 371 (c)(1), (2), (4) Date: Nov. 7, 2000

(87) PCT Pub. No.: WO99/27608

PCT Pub. Date: Jun. 3, 1999

Related U.S. Application Data

(60) Provisional application No. 60/066,689, filed on Nov. 22, 1997.

(51) Int. Cl.[7] ..... H01Q 1/38

(52) U.S. Cl. ..... 343/745; 343/792.5

(58) Field of Search ..... 343/745, 792.5, 343/795, 700 MS, 702; H01Q 1/38, 1/36

(56) References Cited

U.S. PATENT DOCUMENTS 4,656,482 A * 4/1987 Peng ..... 343/792.5
5,995,064 A * 11/1999 Yanagisawa et al. ..... 343/702

* cited by examiner

*Primary Examiner*—Michael C. Wimer
(74) *Attorney, Agent, or Firm*—McDermott, Will & Emery

(57) ABSTRACT

A cylindrically conformable antenna is formed on a flexible substrate and preferably comprises a complex pattern coupled to a first feedline and, spaced-apart from the complex pattern, a patch that floats electrically. The complex pattern preferably is a fractal pattern, deterministic or otherwise, but need not be a fractal. The shape, size, and position of the patch relative to the complex pattern, as well as the complex pattern itself, produces multiple frequency bands of interest. These bands may be varied by varying the relative parameters associated with the patch and complex pattern. The resultant antenna is substantially smaller than conventional antennas for the same frequency band, has a natural 50 Ω feed impedance and performs substantially as well as larger conventional antennas.

2 Claims, 3 Drawing Sheets

CYLINDRICAL CONFORMABLE ANTENNA ON A PLANAR SUBSTRATE

RELATION TO PREVIOUSLY FILED APPLICATION

Priority is claimed to applicant's U.S. provisional patent application Ser. No. 60/066,689, filed Nov. 22, 1997, and entitled "Cylindrical Conformable Antenna on a Planar Substrate".

FIELD OF THE INVENTION

The present invention relates to miniaturized antennas suitable for communication systems including cellular telephones and more particularly to reducing the size of such antennas while still providing an acceptable antenna loading mechanism.

BACKGROUND OF THE INVENTION

Attempts have been made in the prior art to miniaturize antennas for communications. FIG. 1A for example depicts an end-loaded shortened dipole antenna 10 with a meander-line counterpoise 20. A commercially available antenna 10 such as shown in FIG. 1A suitable for cellular telephony is marketed by Radio Shack Corp. The size of antenna 10 may be compared to the enlarged U.S. quarter, shown in FIG. 1B, the enlargement being the same for FIGS. 1A and 1B. A common resonant frequency for the prior art antenna of FIG. 1A is about 870 MHz.

FIG. 1C depicts antenna 10 used with a cellular telephone 30. While antennas such as antenna 10 do function, they are several cm in length or must be pulled-out to a length of several cm. This length makes the antenna and/or cellular telephone (or other transceiver device) somewhat vulnerable to breakage. Clearly a smaller version of a cellular telephone-type antenna would be bene-As described in the following sections, fractal patterns are preferably used with the present invention. By way of further background, applicant refers to and incorporates herein by reference his PCT patent application PCT/US96/13086, international filing date 8 August 1996, priority date 9 August 1995, entitled "Fractal Antennas and Resonators, and Loading Elements".

SUMMARY OF THE INVENTION

The present invention provides an antenna configuration comprising a flexible substrate having spaced-apart first and second surfaces. A conductive pattern is formed on the first surface, the pattern preferably defining complex geometry such as a fractal of first or higher iteration. One portion of the complex pattern defines a feed-point to which RF energy may be coupled or received. (Preferably the other feedpoint will be a groundplane associated with the environment with which the antenna is used, for example the interior shell of a cellular telephone.) The frequency characteristics of the antenna may be tuned by varying the iteration and/or shape of the fractal.

More preferably, tuning is facilitated by disposing a conductive patch spaced-apart by about the substrate thickness from the complex pattern. The patch may be a small square or rectangle or other shape. The patch "floats" electrically in that it is not directly coupled to any feedline. Instead, the patch acts as a capacitive load that can capacitive couple various locations in the complex pattern. The preferably dielectric substrate couples RF current through the substrate thickness. RF current in the complex pattern on the first surface differs in magnitude from location to location at the through-substrate coupling regions.

On one hand, the complex geometry on the first surface contributes an inductive loading. On the other hand, the patch on the second surface contributes a capacitive loading. In combination, the two loading effects produce a monopole that is dimensionally small physically yet is an efficient radiator of RF energy and exhibits a multiband frequency characteristic. Multiple frequency bands of interest may be produced and tailored by the size, configuration, and/or position of the patch relative to the complex pattern, as well as by the complex pattern itself. If desired, the patch can be formed on a separate layer of substrate that is slid or otherwise moved about relative to the location of the complex pattern, to tune characteristics of the antenna.

The preferably flexible substrate(s) may be partially rolled to form a semi-cylindrical or cylindrical shape. The conformally rolled substrate (with complex pattern and patch on the spaced-apart surfaces) may then be inserted into a cylinder and used to replace the "ducky" or "stubby" antenna commonly used in cellular telephone or transceiver applications.

Other features and advantages of the invention will appear from the following description in which the preferred embodiments have been set forth in detail, in conjunction with the accompanying drawings.

DETAILED DESCRIPTION OF THE PREFERRED EMBODIMENT

Figure 1C:
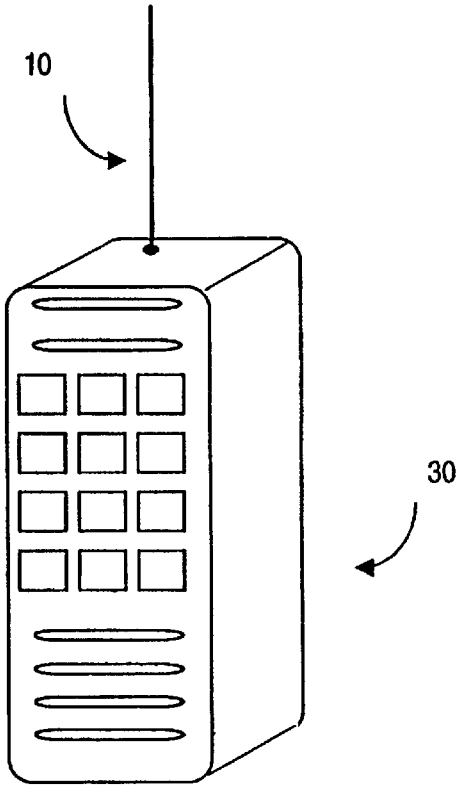
FIG. 1C (PRIOR ART)
FIG. 1C depicts a communications transceiver equipped with a prior art antenna such as that shown in FIG. 1A.
Figure 1B:
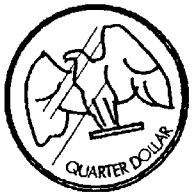
FIG. 1B depicts a U.S. quarter, enlarged to the same scale as the prior art antenna of FIG. 1A.
Figure 2B:
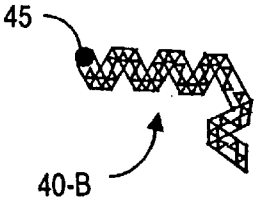
FIG. 2B depicts another exemplary complex pattern suitable for the present invention, here a third iteration Sierpinski fractal ribbon.
Figure 2A:
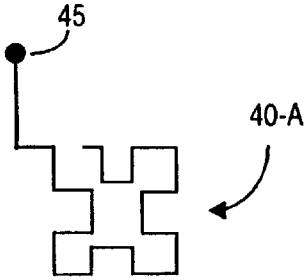
FIG. 2A depicts an exemplary complex pattern suitable for the present invention, here a first iteration Minkowski fractal.
Figure 1A:
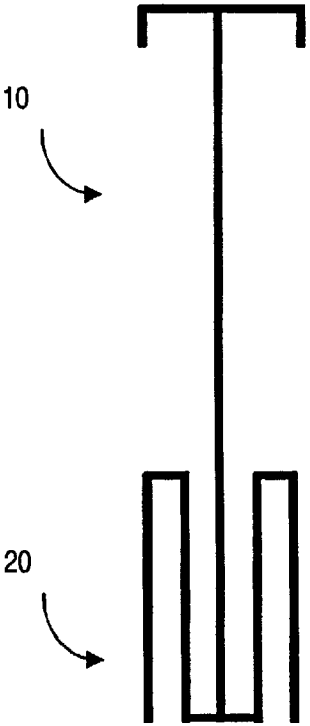
FIG. 1A (PRIOR ART)
FIG. 1A depicts a miniaturized cellular telephone antenna, according to the prior art.

As will be described, the present invention comprises a substrate having first and second surfaces spaced-apart by the typically sub-mm substrate thickness. A complex pattern of conductive material is formed on the first surface, for example a first or higher iteration fractal pattern. FIG. 2A depicts an exemplary such pattern 40-A, namely a first iteration Minkowski fractal geometry having an RF feed-point 45. FIG. 2B depicts another exemplary such pattern 40-B, here a third iteration Sierpinski ribbon, again with an RF feedpoint 45. For ease of comparison, the geometries of FIGS. 2A and 2B are drawn to the same scale as what is depicted in FIG. 1A and 1B.

If fractal configurations are employed, other fractal patterns may include (without limitation) Koch, Cantor, torn square, Mandelbrot, Caley tree, monkey's swing, and Julia. Thus FIGS. 2A and 2B depict but two exemplary complex patterns, but other patterns including deterministic and non-deterministic fractals, and non-fractal geometries may instead be used.

Fractal patterns comprise at least a first motif and a first replication of that first motif. Fractals of iteration greater than two may be defined as also including a second replication of the first motif such that a point chosen on a geometric figure represented by said first motif will result in a corresponding point on both the first replication and the said second replication of the first motif. Further, there will exist at least one non-straight line locus connecting each such point. The definition of a greater than first order fractal may be said to require that replication of the first motif is a change selected from a group consisting of (a) a rotation and change of scale of the first motif, (b) a linear displacement translation and a change of scale of said the motif, and (c) a rotation and a linear displacement translation and a change of scale of said the motif.

Figure 3A:
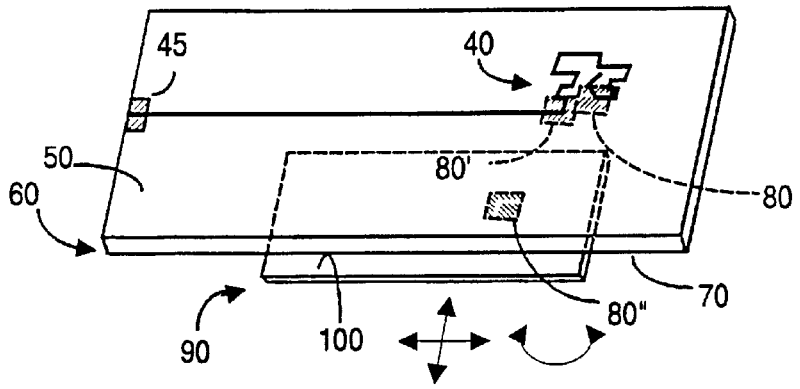
FIG. 3A depicts a preferred embodiment of the present invention in a preliminary stage of formation.

Turning now to FIG. 3A, complex pattern 40 (which is understood to include without limitation first or higher order fractals, (deterministic and non-deterministic) or non-fractal configurations is formed on first surface 50 of substrate 60. The pattern of FIG. 3A may also be described as a stubbed open-loop configuration.

Substrate 60 is preferably a dielectric material, for example the polymeric material sold under the trademark Mylar®, polyester, etc. having a thickness of less than 1 mm. In FIG. 3A, the length and width of dielectric substrate 60 are perhaps 18 mm×12 mm, although other dimensions could instead be used.

Complex pattern 40 may be formed using a variety of techniques. Substrate 60 may for example be double-sided flexible printed circuit board, in which case pattern 40 may be formed using conventional pattern and etching techniques. Alternatively, pattern 40 could be printed or sprayed or sputtered onto substrate 60 using electrically conductive paint. The advantage of using a fractal configuration for pattern 40 is that the effective area required for the pattern is reduced, although the perimeter length of the pattern is increased. A portion 45 of pattern 40 is used as an RF feedpoint, whereat a lead from RF cable may be attached.

Two embodiments are shown simultaneously in FIG. 3A. In one embodiment, patch 80 is formed on second surface 70 of substrate 60. If patch 80 is rectangular in shape, typical dimensions for use at cellular telephone frequencies are perhaps about 10 mm× about 3 mm. Patch 80 is formed from electrically conductive material and may be created by depositing or spraying or painting conductive paint (or the like), or by etching away from surface 70 all conductive material except patch 80. As noted, patch 80 floats in that no direct electrical connections are made to it. The geometry, size, and/or location of patch 80 relative to complex pattern 40 is varied to alter characteristics of the overall antenna to be formed. In practice, the desired relationship between complex pattern 40 and patch 80 may be determined in a laboratory environment by trial and error. However once determined, the resultant double-sided substrate configuration may then be mass produced at relatively low cost. Patch 80', for example, shows a different location relative to complex pattern 40 relative to patch 80. Thus, if patch 80' is used, a different antenna characteristic can result than if patch 80 were instead used.

Note in FIG. 3A that an optional second substrate 90 is shown, whose upper surface 100 contains an electrically conductive patch 80". Assume now that neither patch 80 or 80' is present (although if desired, one or more such patches could be present). Patch 80" essentially abuts second surface 70 of substrate 60. In this embodiment, field tuning of the overall antenna can readily be accomplished by sliding substrate 90 relative to substrate 60, circularly and/or linearly as indicated by the two sets of double-arrowed lines. In this fashion, patch 80" can be oriented in an optimum location by moving one substrate relative to the other. Once an optimum location and/or orientation (e.g., rotary movement) is determined, the substrates can be secured one to the other using clamps, adhesive, or other attachment mechanisms.

Figure 3B:
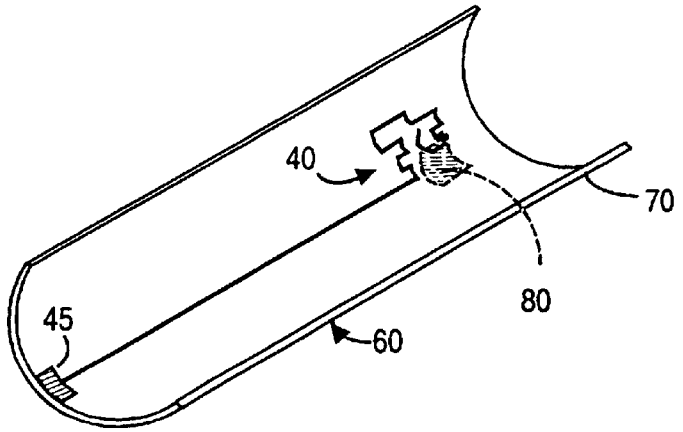
FIG. 3B depicts the embodiment of FIG. 3A with the substrate partially rolled.
Figure 3C:
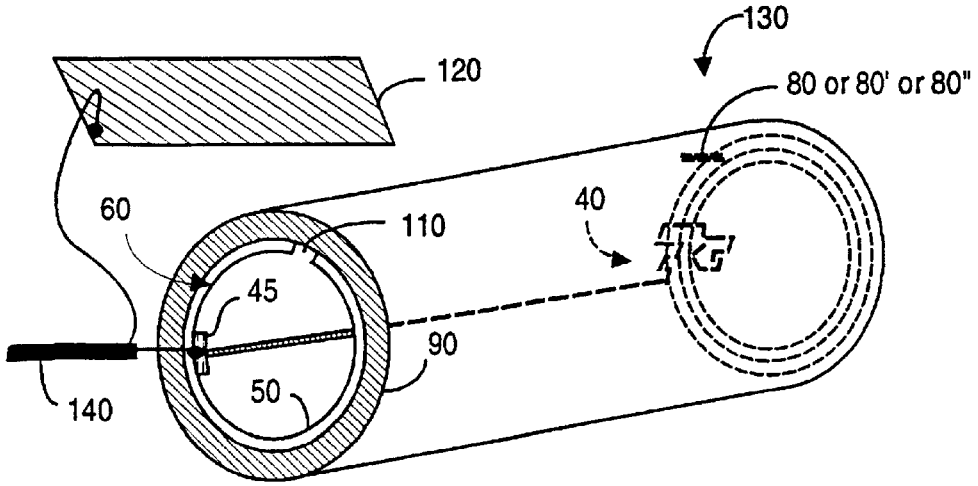
FIG. 3C depicts the embodiment of 3B with the substrate inserted within a cylindrical form.

In FIG. 3B, substrate 60 is shown in the process of being curved, which is one advantage of a flexible substrate. In this embodiment, a patch 80 is shown fabricated on second side 70 of the substrate. In FIG. 3C substrate 60 has been conformed to an almost closed cylindrical shape and is depicted as being inserted into a closed cylinder 90. A gap 110 may exist if substrate 60 does not close fully upon itself, but the presence or absence of such a gap is not important. A rolled or cylindrically shaped antenna system 130 lends its readily to functioning as a substitute for the stub or ducky type antennas 10 used with communication transceivers 30, as depicted in FIG. 1C.

If desired, patch 80, 80', or 80" (or more than one patch) may in fact be formed on the interior surface of cylinder 90. This permits a mechanism for tuning the resultant antenna system 130, namely by rotating and/or laterally moving substrate 60 relative to cylinder 90. For example, microthreads might be formed such that substrate 60 screws into cylinder 90. A fine veneer mechanism may also (or instead) be formed to facilitate fine tuning, if desired.

In FIG. 3C, a feedline 140 (e.g., 50 Ω coax) is shown coupled to feedpoint 45 and to a ground plane 120. In practice, ground plane 120 may be the interior shell of the electronic device with which antenna 130 is used. For example, in the embodiment of FIG. 4A, the electronic device is a cellular telephone or transceiver 30 (which may be similar to that shown in FIG. 1C), and ground plane 120 may be a metal plate or perhaps metallic paint sprayed on a portion of the interior housing of device 30.

Figure 4B:
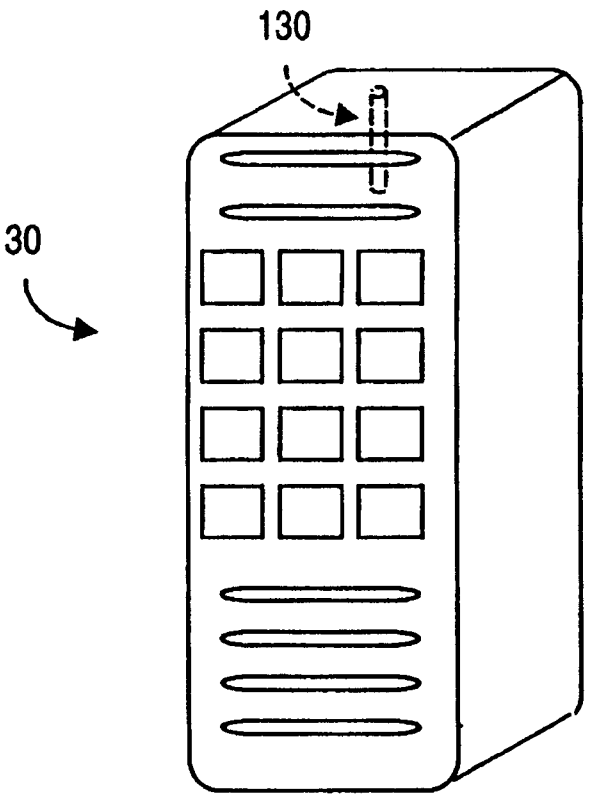
FIG. 4B depicts a communications transceiver equipped with an internal antenna, according to the present invention.
Figure 4A:
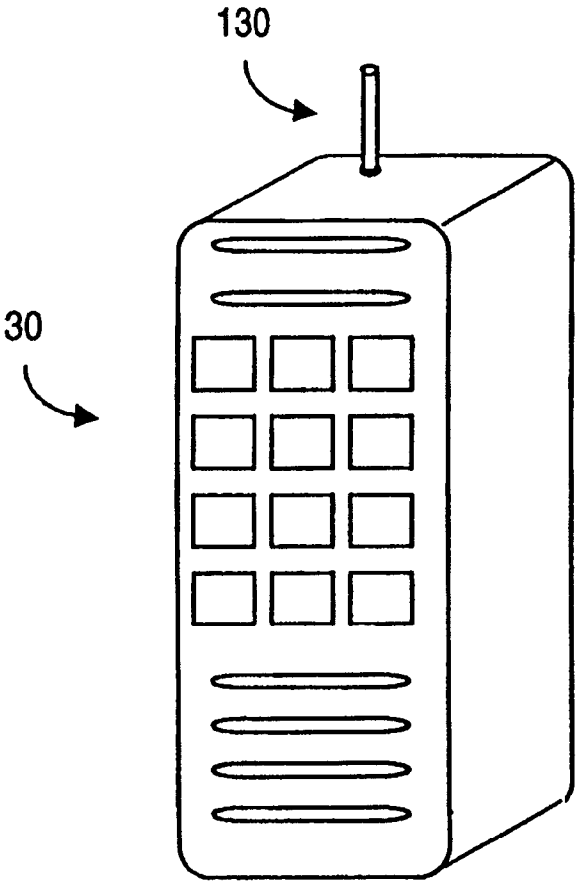
FIG. 4A depicts a communications transceiver equipped with an external antenna, according to the present invention.

In FIG. 4A, an antenna system 130 according to the present invention is shown protruding from the housing of device 30. However in stark contrast to antenna 10 shown in FIG. 1C (whose overall length may be 70 mm), the over-all length of antenna 130 will be perhaps 15 mm (for cellular telephone frequencies). Indeed, as shown in FIG. 4B, antenna 130 is sufficiently small to be mounted inside the housing of device 30. As such, antenna 130 is immune to damage from being broken off device 30, in contrast to antenna 10 in FIG. 1C.

The present invention has been found to provide a natural approximately 50 Ω feed impedance, thus obviating the need for matching transformers, stubs, or the like. Further, the present invention provides an omni-directional gain and bandwidth that is substantially identical to the performance of conventional antenna 10 in FIG. 1C, notwithstanding that the present invention is substantially smaller than antenna 10.

Although the preferred embodiment has been described with respect to use with a cellular telephone communication system, those skilled in the art will appreciate that applicant's fractal antenna system may be used with other systems, including without limitation transmitters, receivers, and transceivers.

Modifications and variations may be made to the disclosed embodiments without departing from the subject and spirit of the invention as defined by the following claims.

What is claimed is:

1. An antenna system, comprising:

a substrate having first and second surfaces; and a complex pattern of electrically conductive material formed on said first surface, a location on said complex pattern defining a feedline feedpoint; a patch adjacent said second surface and spaced-apart from said complex pattern; said patch being formed from electrically conductive material and floating electrically;

wherein said patch contributes a capacitive loading effect to said antenna system;

wherein at least one characteristic of said antenna system is varied by at least one of orientation and size of said patch relative to said complex pattern;

wherein said complex pattern contributes an inductive loading effect to said antenna system, and said antenna system exhibits multiple frequency resonant bands that are alterable by varying said complex pattern;

wherein said complex pattern defines at least a second order fractal and includes a portion having at least a first motif and a first replication of said first motif and a second replication of said first motif such that a point chosen on a geometric figure represented by said first motif will result in a corresponding point on said first replication and on said second replication of said first motif; wherein there exists at least one non-straight line locus connecting each said point; and wherein a replication of said first motif is a change selected from a group consisting of (a) a rotation and change of scale of said first motif, (b) a linear displacement translation and a change of scale of said first motif, and (c) a rotation and a linear displacement translation and a change of scale of said first motif.

2. The system of claim 1, wherein said first motif is selected from a group consisting of (i) Koch, (ii) Minkowski, (iii) cantor, (iv) torn square, (v) Mandelbrot, (vi) Caley tree, (vii) monkey's swing, (viii) Sierpinski gasket, and (ix) Julia.

* * * * *